United States Patent [19]

Machin et al.

[11] Patent Number: 5,021,195

[45] Date of Patent: Jun. 4, 1991

[54] STRUCTURED AQUEOUS DETERGENT COMPOSITIONS CONTAINING SALTING-OUT ELECTROLYTES AND SURFACTANTS AND METHODS OF FORMING THEM

[75] Inventors: David Machin; Appaya Naik, both of Oxton, Great Britain; Cornelis Buytenhek; Johannes C. van de Pas, both of Vlaardingen, Netherlands

[73] Assignee: Lever Brothers Company, New York, N.Y.

[21] Appl. No.: 308,343

[22] Filed: Feb. 8, 1989

[30] Foreign Application Priority Data

Feb. 10, 1988 [GB] United Kingdom ..... 8803037

[51] Int. Cl.[5] ..... C11D 1/00

[52] U.S. Cl. ..... 252/545; 252/532; 252/528; 252/174.25; 252/DIG. 14; 252/113; 252/116; 252/128; 252/174.23; 252/174.21; 252/173; 252/547; 252/548; 252/559

[58] Field of Search ..... 252/532, 533, 534, 528, 252/135, 173, 174.25, DIG. 14, 113, 116, 128, 174.23, 545, 547, 548, 174.21

[56] References Cited

U.S. PATENT DOCUMENTS

| | | | |
|---|---|---|---|
| 3,956,158 | 5/1976 | Donaldson | 252/102 |
| 4,515,704 | 5/1985 | Akred | 252/135 |
| 4,530,780 | 7/1985 | van de Pas | 252/528 |
| 4,618,446 | 10/1986 | Haslop | 252/135 |
| 4,732,703 | 3/1988 | van Voorst Vader | 252/532 |

FOREIGN PATENT DOCUMENTS

| | | |
|---|---|---|
| 1390503 | 4/1975 | European Pat. Off. . |
| 0070076 | 1/1980 | European Pat. Off. . |
| 070074 | 1/1983 | European Pat. Off. . |
| 0070075 | 1/1983 | European Pat. Off. . |
| 0075994 | 4/1983 | European Pat. Off. . |
| 0075995 | 4/1983 | European Pat. Off. . |
| 0075996 | 4/1983 | European Pat. Off. . |
| 0092877 | 11/1983 | European Pat. Off. . |
| 2170235 | 6/1980 | United Kingdom . |
| 2123846 | 2/1984 | United Kingdom . |
| 2153380 | 12/1984 | United Kingdom . |

*Primary Examiner*—Prince E. Willis
*Assistant Examiner*—J. Silbermann
*Attorney, Agent, or Firm*—Ronald A. Koatz

[57] ABSTRACT

A structured aqueous detergent composition containing detergent-active material in the form of at least one detergent-active component and at least one electrolyte and having the following phases:

(a) an isotropic aqueous solution forming a continuous phase;

(b) distributed and suspended in said solution (a) discrete units of one or more non-network-forming phases, each selected from the following:

(i) solid particles containing detergent-active material, (ii) lyotropic liquid crystals containing detergent-active material; and (iii) non-encapsulated liquid droplets containing detergent-active material, (c) one or more suspending phases which cause the composition to be structured so as to suspend the non-network-forming phase (b); said non-network-forming phase (b) having a higher concentration by weight of detergent-active material than said aqueous solution (a).

13 Claims, No Drawings

STRUCTURED AQUEOUS DETERGENT COMPOSITIONS CONTAINING SALTING-OUT ELECTROLYTES AND SURFACTANTS AND METHODS OF FORMING THEM

This invention relates to structured aqueous detergent compositions and to methods of forming such compositions. The compositions of the invention have a wide variety of uses, in different forms, and may be high-foaming or low-foaming compositions.

The principal aim of the present invention is to provide liquid compositions containing detergent-active material at relatively high concentration which nevertheless are stable and have low enough viscosities for ease of handling and ease of dispersion in use. The commercial advantage of detergent compositions of higher concentration than have generally been available on the market hitherto lie in lower packaging, transport and storage cost.

Higher concentrations of detergent material can be obtained with the use of hydrotropes, but these have cost, environmental and safety disadvantages. An alternative approach is to look for stable compositions which contain phases in addition to, or other than, an aqueous isotropic solution. At higher concentration, detergent-active materials often form lamellar or G phases, which leads to a greater increase of viscosity. This increase of viscosity restricts the concentration increase which can be usefully obtained. Such compositions, containing lamellar phases, have a suspending effect on solid particles distributed in them, which has been put to use, but the presence of solid particles, e.g. of builder or abrasive, further increases viscosity, so that again the concentration increase which can be obtained is restricted. EP-A-86614 describes various suspending detergent compositions which contain phases which are separable from the isotropic aqueous phase on centrifuging. The suspended component is solid builder particles. The compositions in question are generally classified by their centrifuging properties into two groups, called Group II and Group III. Those of Group II show three layers on centrifuging, i.e. a non-viscous liquid aqueous layer, a viscous layer which contains a major proportion of the detergent-active material and a solid layer consisting predominantly of builder. These compositions show some lamellar structure in X-ray and neutron diffraction studies and by electron microscopy. The compositions are apparently not fully stable, becoming more gel-like on ageing. The compositions of Group III on the one hand, while also showing lamellar structure, differ from those of Group II in that on centrifuging they produce an aqueous liquid phase and a solid layer which is a mixture of a solid surfactant phase and a solid builder. The Group III compositions are thought to consist of an aqueous phase containing relatively little surfactant and a relatively weak three-dimensional network of solid surfactant hydrate, which provides the structuring effect for the suspended solid builder particles. This disclosure therefore appears to be an exploration of the possibilities for forming suspending stable compositions where at least part of the surfactant forms a suspending lamellar structure, the degree of structure varying between the Group II type and Group III type compositions. The limitations which the viscosity of such compositions imposes on concentration and adaptability of formulation are therefore not avoided.

The present invention adopts a different approach. The essence of the present invention is that, in a structured detergent composition, at least some of the detergent-active material is in a non-network-forming non-continuous phase which is distributed or dispersed through the isotropic aqueous phase. Structuring is provided by one or more suspending phases which cause the composition to be structured so as to suspend the non-network-forming phase or phases. The distributed discrete units of the non-network-forming phase contribute little to the viscosity and/or instability of the composition, enabling concentration to be varied widely without affecting viscosity unduly. The compositions are stable, i.e. stable at 20° C.

According to the present invention in one aspect, there is provided a structured aqueous detergent composition containing detergent-active material in the form of at least one detergent-active component and at least one electrolyte and having the following phases:

(a) an isotropic solution forming a continuous phase;

(b) distributed and suspended in said solution (a) discrete units of one or more non-network-forming phases, each selected from the following:

(i) solid particles containing detergent-active material, (ii) lyotropic liquid crystals containing detergent-active material; and (iii) non-encapsultated liquid droplets containing detergent-active material, (c) one or more suspending phases which cause the composition to be structured so as to suspend the non-network-forming phase (b);

said non-network-forming phase (b) having a higher concentration by weight of detergent-active material than said aqueous solution (a).

The discrete units of the non-network-forming phase (b) are preferably less than 10 μm in average size.

The suspending phase or phases (c) may be selected from (i) a lamellar phase formed by detergent-active material, (ii) non-surfactant structuring material, (iii) filamentary structuring material. In particular, preferably said lamellar phase (c)(i) is present, in which case it is preferred that the non-network-forming phase (b) has a higher concentration by weight of detergent-active material than the lamellar phase (c)(i). Preferably, also the detergent-active material in the lamellar phase (c)(i) is significantly different in composition from the detergent-active material present in the non-network-forming phase (b), at least in respect of chain length distributed and/or ratio of components, and it may be different in chemical nature of the detergent-active material.

The lamellar phase (c)(i) when present is preferably in the form of spherulites or multi-layered vesicles.

When the non-surfactant structuring material phase (c)(ii) is present, it is preferably in the form of polymer and/or an inorganic colloid.

When the filamentary phase (c)(iii) is present, it is preferably in the form of filamentary soap crystals or cellulose.

The aqueous detergent composition can also, for some purposes, advantageously include a further suspended phase (d) of solid particles (different from said solid particles (b)(i) if present). This suspended phase (d) may be at least one of mineral abrasive particles, builder particles, softener particles and substantially water-insoluble bleaching agent particles.

A principal advantage of the invention is that it enables the production of physically stable compositions which have a lower viscosity than similar or identical compositions having conventional phase structures, or it may even be that an equivalent stable composition cannot be produced conventionally. Accordingly, an aqueous detergent composition of the invention is preferred which satisfies one of the following conditions:

(i) it has a viscosity at the shear rate 21 $s^{-1}$. which is substantially less than the viscosity of a corresponding composition which is physically stable for 1 hour and contains in all respects the same components but in which the detergent-active material(s) is/are entirely in said solution (a) or in said aqueous solution (a) and said lamellar phase (c)(i) if the latter is present, (ii) such a corresponding composition cannot be made.

A detergent composition according to the invention preferably has a viscosity of less than 2.5 PaS, preferably less than 1.0 PaS, at a shear rate of 21 $S^{-1}$. It is also preferred that if the detergent composition comprises a non-network-forming phase (b)(i) and/or (b)(ii) the detergent composition does give substantially no clear layer formation upon centrifuging at 800 G at 25° C. for 17 hours.

Similarly, a detergent composition according to the invention is preferred which contains at least two detergent-active materials and which satisfies the condition that, in respect of each detergent-active material, notional gradual replacement of that material by the other detergent-active material (where there are two in total) or by the other detergent-active materials in the ratio in which they are present in the composition (where there are more than two) leads from a region of physical stability to a region of higher viscosity or physical instability. The term "notional replacement" here means that, in practice, comparative compositions of different proportions of components are made up, in order to perform this test. Note that, according to this test, the preferred composition of the invention is in a region of stability; slightly differing compositions may be in the same region of stability.

Preferably, the aqueous detergent composition according to the invention contains as detergent-active material one or more non-alkoxylated anionic surfactants, which at least predominantly form said non-network-forming phases b(i) and/or b(ii). As further detergent-active material, in addition to said non-alkoxylated anionic surfactant(s), the composition preferably contains one or more of alkoxylated anionic surfactants
alkoxylated nonionic surfactants
mono- and di-alkanolamides
amine oxides
betaines
sulphobetaines
sugar ethers which further material at least partly forms lamellar phase c(i) together with said non-alkoxylated anionic surfactant.

The composition of the invention preferably has a total concentration by weight of detergent-active material of at least 15%, more preferably at least 20%.

Compositions according to the invention may be prepared by a variety of methods, which are well-known in the preparation of structured liquid detergent compositions. Any method resulting in structured aqueous detergent compositions comprising an isotropic phase (a), a non-network-forming, discrete phase (b) and a suspending phase (c) can be used.

In selecting the appropriate method, the most important aspect distinguishing methods for formulation of the claimed compositions from other methods for preparing a structured aqueous detergent composition is that a non-network-forming, discrete phase (b) is formed, and that the ingredients intended to form this phase are at least partly formed into this phase and not predominantly into a network forming and/or other suspending phase. When phase (b)(iii) is present, that phase can conveniently be formed by dissolving the active materials including the surfactants in water preferably at room temperature and adding electrolyte with stirring to form phase b(iii) and c.

In principle, where phase (b)(i) or phase (b)(ii) is present, that phase can be added in the form of particles before or after "structuring" of the liquid phases. However, it has been found more convenient to form such phases in situ.

A discrete phase (b)(i) or b(ii) can, for instance, be obtained by cooling, use of high concentration of detergent-active material, and by addition of electrolytes. It has been found that for ensuring that indeed a phase (b)(i) or (b)(ii) is formed in situ, this phase needs preferably to be formed before the formation of the suspending phase (c).

The presence of a non-network-forming phase (b) can be detected by measuring the viscosity of the product. Owing to the fact that the non-network-forming discrete phase (B) does not contribute to a higher viscosity, the viscosity of a system wherein phase (b) is present is generally lower than the viscosity of a system which contains the same ingredients but wherein the ingredients do no form a discrete phase (b).

Furthermore, the presence of a non-network-forming phase may be detected by any other conventional method of detecting the presence of a discrete phase. Preferred methods include X-ray diffraction, electron microscopy and centrifuging.

As indicated above, the discrete, non-network-forming phase (b)(i) or b(ii) is preferably formed before the formation of the suspending phase (c). Detection of the discrete phase, in order to distinguish between a claimed product and a product outside the invention could therefore also be done in assessing the properties of the intermediate product which is obtained after the formation of phase (b), but before the final formation of phase (c).

It is believed to be within the daily practice of a skilled man to find the remaining process parameters, resulting in a structured aqueous detergent system as presently claimed.

According to the invention, in another aspect therefore there is provided a method of forming a structured aqueous detergent composition in which the non-network-forming phase (b)(i) and/or the non-network-forming phase (b)(ii) is/are present and the lamellar phase c(i) is present, the method comprising the steps:

(A) preparing an aqueous solution of a first detergent-active component, (B) after step (A) adding electrolyte to the aqueous solution so produced in order to cause said first component to form said non-network-forming phase(s) (b)(i) and/or b(ii), and thereafter forming said lamellar phase (c)(i) by at least one of the following steps:

($C_1$) dissolving in the solution a second detergent-active component more soluble in water than said first component, ($C_2$) adding further electrolyte to the solution. Preferably, all of steps (A), (B), ($C_1$) and ($C_2$) are performed. Part of said second component may be included in the aqueous solution of step (A).

Compared with adding the non-network-forming phase as particles, this method has the advantages that problems of stirring in the particles are avoided and that a problem of achieving partial solution of the particles (which is needed if the material of the particles is to form the structuring phase c(i)) is avoided. The method here proposed also allows the use of a wide variety of raw materials.

In the case where step ($C_2$) is performed in the above method, said electrolyte added in step (B) may have a monovalent anion while said electrolyte added in step $C_2$ has a polyvalent anion.

Part of the water content of the composition formed may be added after the addition of all detergent-active material and all electrolyte. This technique is of general application. Therefore the invention further provides a method of preparing a composition of the invention as described above wherein the lamellar phase c(i) and the non-network-forming phase b(i) and/or b(ii) are present, in which method part of the final water content of the composition formed is added after the addition of all detergent-active material and all electrolyte. In this method, the formation of the non-network-forming phase can be achieved by the high concentration of the detergent-active materials and electrolyte, prior to the final addition of water.

This part of the final water content added after the addition of all detergent-active material and all electrolyte may be 5 to 30% of the total amount of water incorporated in the composition other than water added in association with other components.

In principle, the present invention can employ a very wide range of detergent-active materials. Examples of known materials which can be employed are:

non-alkoxylated anionic surfactants, such as
- alkyl benzene sulphonates
- secondary alkane sulphonates
- α-olefin sulphonates
- alkyl sulphocarboxylates
- alkyl glyceryl ether sulphonates
- fatty acid monoglyceride sulphates and sulphonates
- fatty acid ester sulphonates
- dialkyl sulphosuccinates
- primary and secondary alkane sulphonates
- soaps alkoxylated anionic surfactants, such as
- alkyl ether sulphates
- alkyl ether carboxylates
- alkyl ether phosphates alkoxylated nonionic surfactants, such as
- alkoxylated alcohols
- alkoxylated alkylphenols other nonionic surfactants, such as
- fatty acid alkylolamides
- alkylamides
- alkyl mercaptans
- amine oxides mono- and di-alkanolamides ethoxylated alkanolamides betains, sulphobetaines sugar ethers, e.g. alkyl polysaccharides

EXAMPLES

In the Examples, all components are given in parts by weight, except where otherwise indicated.

The raw materials used in the Examples are:

N500 (Na) : sodium alkyl (mainly $C_{11-13}$) benzene sulphonate Nalken N-500 ex Nissan Conoco. Mean molecular weight about 343–349.

N500 ($NH_4$) : ammonium version of N500 (Na)

Dob 23-3S : sodium alkyl ($C_{12-13}$) ether (mean of 3 ethylene oxide groups) sulphate, ex Shell Dob 23-3A : ammonium version of Dob 23-3S Dob 91 8EO : $C_{9-11}$ alcohol ethoxylate (mean of 8 ethylene oxide groups), ex Shell (Dobanol)

Durcal 65 : ground calcite, mean particle size 65 microns, ex Omya

Dob 102 (Na) : sodium alkyl (mainly $C_{10-12}$) benzene sulphonate, ex Shell. Mean molecular weight about 336–341

LDA : Empilan LDE, ex Albright and Wilson. Mainly $C_{12}$ diethanolamide

LAS : Marlon AS-3 ex Hüls. Alkyl (mainly $C_{11-13}$) benzene sulphonic acid. Mean molecular weight about 318–321.

LEC : lauryl (C12) ether (mean of 4.5 ethylene oxide groups) carboxylic acid. Akypo RLM 45, ex Chem-Y.

LEP : mixture of mono- and di-alkyl ($C_{12-15}$) ether (mean of 5 ethylene oxide groups) phosphoric acid. Crodafos 25D5, ex Croda.

Synperonic A7 : $C_{13-15}$ alcohol ethoxylate (mean of 7 ethylene groups). Synperonic A7, ex ICI NTA : sodium nitrilotriacetate. Trilon A92, ex BASF.

Petrelab 550 : sodium alkyl (mainly $C_{11-13}$) benzene sulphonate ex Petresa. Mean molecular weight about 343.

Soap : potassium salt of Prifac 7947, ex Unichema. Mixed (mainly $C_{12-18}$) fatty acids about 20% saturated.

STP : sodium triphosphate, Thermophos NW, ex Knapsack.

Examples I and II illustrate a preferred method for preparing compositions according to the invention. Examples A-D illustrate methods for preparing a detergent composition, not resulting in a structured aqueous detergent composition as claimed. They are set out in Table 1 and illustrate the method of making compositions of the invention in which a less soluble detergent-active material is precipitated out before structuring of the composition. In each case, in step (i) the mixture (a) is heated to achieve a clear solution, in step (ii) the electrolyte (b) is added at room temperature with stirring, in step (iii) the nonionic detergent-active material (c) is added at room temperature with stirring and finally in step (iv) where applicable component (d) is added at room temperature with stirring. The amount of water used in step (i) is equal to the amount required to balance to 100 in the final composition.

In Examples A–C, where $Na_2SO_4$ was used in step (ii), very little or no precipitation of the alkylbenzene sulphonate took place. This shows that $Na_2SO_4$ is a good electrolyte for creating a suspending lamellar phase, i.e. for "structuring" but a poor one for creating a non-network-forming detergent phase, i.e. for "precipitating". Thus, the compositions because structured at step (ii), and high viscosities resulted. This was not greatly affected by the absence of the co-active alkyl ether sulphate in Example C.

Here and elsewhere in the Examples the term "precipitation" is used to describe the formation of lyotropic liquid crystals (phase b(ii) of claim 1) as well as the formation of solid particles (phase b(i) of claim 1).

In Example D, 4% of NaCl at step (ii) caused so much precipitation of alkyl benzene sulphonate that a sufficiently strongly suspending lamellar phase could not be created in steps (iii) and (iv) even by prolonged heating. In Examples I and II of the present invention, however, control of precipitation of alkylbenzene sulphonate was achieved using lesser amounts of NaCl, and the addition of nonionic, perfume and $Na_2SO_4$ subsequently caused structuring to produce a composition of low viscosity in which the lamellar phase produced in the structuring suspends the precipitated alkylbenzene sulphonate particles. The monovalent chloride ion is used for precipitation and the polyvalent sulphate ion for structuring.

TABLE 1

| | | | A | B | C | D | I | II |
|---|---|---|---|---|---|---|---|---|
| (a) N500 (Na) | Heated to clear | (i) | 20 | 20 | 20 | 20 | 20 | 20 |
| Dob 23-3S | | | 2.5 | 2.5 | — | 2.5 | 2.5 | 2.5 |
| $H_2O$ | | | 100 | 100 | 100 | 100 | 100 | 100 |
| (b) $Na_2SO_4$ | Added at RT with stirring | (ii) | 6 | 8 | 6 | — | — | — |
| NaCl | | | — | — | — | 4 | 3 | 2 |
| (c) Dob 91 8EO | Then added at RT with stirring | (iii) | 2.5 | 2.5 | 2.5 | 2.5 | 2.5 | 2.5 |
| Perf. | | | 0.3 | 0.3 | 0.3 | 0.3 | 0.3 | 0.3 |
| (d) Dob 23-3S | Then added at RT with stirring | (iv) | — | — | 2.5 | — | — | — |
| $Na_2SO_4$ | | | — | — | — | 4 | 5 | 6 |
| Viscosity (cp) | | | 1792 | 1728 | 1730 | unstable | slightly structured (200 cp) | strongly structure 700 cp |

Examples II–V of the invention (Table 2) illustrate methods and compositions of the invention using $MgCl_2$ as electrolyte and show that abrasive mineral particles can be stably suspended (i.e. phase (d) of the claims). Steps (i), (ii), (iii) and (iv) are as in Examples I and II. All three compositions of the invention of Table 2 are physically stable. "Standard" product viscosities are given, i.e. the viscosity which the identical composition has if no alkylbenzene sulphonate is present in precipitated-out form. These "standard" products are produced by adding the electrolyte after all the detergent-active material. The present invention can be seen as to provide great reduction of viscosity. These Examples also show that $MgCl_2$ can be used alone or with $Na_2SO_4$ to precipitate alkylbenzene sulphonate in step (ii) and can also be used for structuring in step (iv).

In Example V no nonionic is used in step (iii), only perfume. In fact the greater amount of alkyl ether sulphate in step (i) stabilizes the alkylbenzene sulphonate to some extent against precipitation, and the resulting product containing suspended precipitated alkylbenzene sulphonate has higher viscosity than e.g. in Example IV.

TABLE 2

| | | | III | IV | V |
|---|---|---|---|---|---|
| (a) N500 (Na) | Heated to clear | (i) | 20 | 20 | 20 |
| Dob 23-3S | | | 2.5 | 2.5 | 2.5 |
| $H_2O$ | | | 100 | 100 | 100 |
| (b) $MgCl_26H_2O$ | Added at RT with stirring | (ii) | 4 | 2 | 2 |
| Perf. | | | — | 4 | 4 |
| (c) Dob 91 8EO | Then added at RT with stirring | (iii) | 2.5 | 2.5 | — |
| Perf. | | | 0.3 | 0.3 | 0.3 |
| (d) $MgCl_26H_2O$ | Then added at RT with stirring | (iv) | — | 2 | 2 |
| $Na_2SO_4$ + | | | 4 | — | — |
| Ducal 65 | | | 10 g | 10 g | 10 g |
| Viscosity | | | 976 | 608 | 1216 |
| Standard product viscosity | | | 1888 | 1888 | 2272 |

The viscosity of product IV after heating for ½ hr on steam was 704 cp. All physically stable Examples VI–VIII of the invention (Table 3) show the effect of the use of ammonium as the counter-cation for the anionic detergent actives. Steps (i)–(iv) are as in Examples I–V. In each case a product of the invention containing suspended precipitate of alkylbenzene sulphonate is obtained. The results show that the ammonium salt of alkylbenzene sulphonate is less sensitive to precipitation than the sodium salt. Hence more electrolyte was required in step (ii) in Example VII than for the sodium salt (Example VIII). Example VIII is identical with Example V except for the absence of Durcal 65.

TABLE 3

| | | | VI | VII | VIII |
|---|---|---|---|---|---|
| (a) N500 ($NH_4$) | Heated to clear | (i) | 20 | 20 | — |
| N500 (Na) | | | — | — | 20 |
| Dob 23-3A | | | 2.5 | 2.5 | — |
| Dob 23-3S | | | — | — | 2.5 |
| $H_2O$ | | | 100 | 100 | 100 |
| (b) $NgCl_26H_2O$ | Added at RT with | (ii) | 4 | 6 | 4 |

TABLE 3-continued

| | | | VI | VII | VIII |
|---|---|---|---|---|---|
| | stirring | | | | |
| (c) Dob 91 8EO | Then added at RT | (iii) | 2.5 | 2.5 | — |
| Perf. | with stirring | | 0.3 | 0.3 | 0.3 |
| (d) $Na_2SO_4$ | Then added at RT with stirring | | 4 | 2 | 4 |
| Viscosity (cp) | | | 1424 | 970 | 976 |

Examples IX and X (Table 4) show methods and products of the invention using a different alkylbenzene sulphonate from Examples I–VIII, the difference being in chain length distribution, phenyl isomer distribution and tertralin content. Steps (i)–(iv) were as above. In Example X, diethanolamide is used in step (iii). By heating, as indicated, stable structured compositions containing suspended precipitated alkylbenzene sulphonate could be obtained, since on heating some precipitated active redissolves.

TABLE 4

| | | | | |
|---|---|---|---|---|
| (a) Dob 102 (Na) | Heated to clear | (i) | 20 | 20 |
| Dob 23-3S | | | 2.5 | 5 |
| $H_2O$ | | | 100 | 100 |
| (b) $MgCl_26H_2O$ | Added at RT with stirring | (ii) | 4 | 4 |
| (c) Dob 91 8EO | Then added with stirring at RT | (iii) | 2.5 | — |
| LDA | | | — | 2 |
| Perf. | | | 0.3 | 0.3 |
| (d) $MgCl_26H_2O$ | Then added at RT with stirring | (iv) | — | 2 |
| | | | Product was unstable, so heated on steam both for ½ hr. | Heated on steam both for 15 min to dissolve LDA |
| Viscosity (cp) | | | 480 | 672 |

Examples XI–XIV illustrate methods and compositions of the invention in which a non-network-forming phase in the form of liquid droplets is formed (phase (b)(iii) of claim 1). Table 5 gives the components and analysis of the phases formed. The phase called "isotropic aqueous" corresponds to the phase (a) of claim 1, the one called "isotropic detergent" is the phase (b)(iii) of claim 1 and the one called "lamellar" is phase (c)(i) of the claims. The compositions were formed by the steps of (i) dissolving the surfactants in water at room temperature, (ii) neutralizing the surfactant acids (LAS, LEC, LEP) with sodium hydroxide, the pH being adjusted to about 12, (iii) adding electrolyte and stirring for 15–30 minutes.

TABLE 5

| | Composition of total liquid detergent (% w/w)* | | | | | | Type and composition (% w/w) of the different phases present | | | | | | |
|---|---|---|---|---|---|---|---|---|---|---|---|---|---|
| | LAS | LEC | LEP | Synp. A7 | NTA | LAS/co-surf | Type of phase | LAS | LEC | LEP | Synp-A7 | NTA | LAS/co-surf |
| XI | 2 | 8 | — | — | 25 | 0.20 | Isotropic aqueous | 0.03 | <0.1 | — | — | 27.9 | — |
| | | | | | | | Isotropic detergent | 1.3 | 12.5 | — | — | 20.0 | 0.094 |
| | | | | | | | Lamellar | 2.7 | 8.2 | — | — | 22.8 | 0.25 |
| XII | 3 | 4 | — | 3 | 15 | 0.30 | Isotropic aqueous | 0.02 | 0.60 | — | 0.10 | 17.3 | — |
| | | | | | | | Isotropic detergent | 5.9 | 7.2 | — | 6.6 | 11.0 | 0.30 |
| | | | | | | | Lamellar | 2.3 | 2.5 | — | 2.2 | 15.2 | 0.33 |
| XIII | 3 | — | 3 | 4 | 15 | 0.30 | Isotropic aqueous | 0.03 | — | 0.05 | 0.10 | 17.4 | — |
| | | | | | | | Isotropic detergent | 7.2 | — | 7.9 | 9.2 | 10.5 | 0.30 |
| | | | | | | | Lamellar | 2.0 | — | 1.95 | 2.2 | 15.9 | 0.33 |
| XIV | 3 | — | 2 | 5 | 15 | 0.30 | Isotropic aqueous | 0.01 | — | 0.02 | 0.01 | 17.3 | — |
| | | | | | | | Isotropic detergent | 8.4 | — | 6.2 | 13.6 | 9.3 | 0.30 |
| | | | | | | | Lamellar | 6.7 | — | 5.5 | 9.5 | 11.6 | 0.31 |

*balance water

Examples XV–XVII are compositions of a type suitable as general purpose cleaner concentrates. Their components and viscosities are set out in Table 6, together with viscosities of equivalent "standard" compositions (see Examples III–V for explanation of "standard" compositions, but note that for Examples XV–XVII the "standard" compositions do not contain the NaCl present in the compositions of the invention). It is believed that these Examples contain isotropic aqueous phase (phase (a) of claim 1), a lamellar phase (phase (c)(i) of the claims) and one or both of phases (b)(i) and (b)(ii) of claim 1 (the soap, when used, tends to form solid particles (phase (b)(i) while the Petrelab 550 lyotropic liquid crystals (phase (b)(ii)). The steps in the method of formation of the compositions XV and XVII of the invention were:

i) Add the Petrelab 550 to water at 60° C.

ii) Stir for 10 minutes iii) Add soap and stir for 10 minutes
iv) Add half of the Synperonic A7, stir for 10 minutes
v) Cool to 30° C.
vi) Add NaCl and stir for 5 minutes
vii) Add $Na_2CO_3$, STP and rest of Synperonic A7
viii) Stir for 15 minutes
ix) Add perfume and stir for 15 minutes The method of making the equivalent "standard" compositions was:

i) Dissolve the $Na_2CO_3$, then the STP in water at 60° C.
ii) Add the Petrelab 550 and stir for 10 minutes
iii) Add the soap and stir for 10 minutes
iv) Add the Synperonic A7 and allow to cool slowly while stirring
v) At about 30° C. add the perfume
vi) Stir for about 5 minutes

TABLE 6

| | Components % by weight | | |
|---|---|---|---|
| Petrelab 550 | 14% | 14% | 14% |
| Soap | — | 2% | 2% |
| Synperonic A7 | 6% | 4% | 4% |
| STP | 2% | 2% | 2% |
| $Na_2CO_3$ | 4% | 4% | 4% |
| NaCl | 1% | 1% | 1.5% |
| Perfume | 1% | 1% | 1% |
| Water to 100% | | | |
| Viscosity (cps at 21 $sec^{-1}$) | 620 | 720 | 570 |
| Standard product viscosity | 925 | 870 | 870 |

We claim:

1. A structured aqueous detergent composition containing detergent-active material in the form of at least one detergent-active component and at least one electrolyte and having the following phases:
(a) an isotropic aqueous solution forming a continuous phase;
(b) distributed and suspended in said solution (a) discrete units of one or more non-network-forming phases, each selected from the following:
(i) solid particles containing detergent-active material,
(ii) lyotropic liquid crystals containing detergent-active material; and
(iii) non-encapsulated liquid droplets containing detergent-active material,
(c) one or more suspending phases which cause the composition to be structured so as to suspend the non-network-forming phase (b);
said non-network-forming phase (b) having a higher concentration by weight of detergent-active material than said aqueous solution (a);
said composition having a viscosity of less than 2.5 Pas and a shear rate of $21S^{-1}$ and, if phase (b)(i) or (b)(ii) is present, the composition giving substantially no clear layer formation upon centrifuging at 800 G at 25° C. for 17 hours.

2. An aqueous detergent composition according to claim 1, wherein the suspending phase (c) is a lamellar phase in the form of spherulites or multi-layered vesicles of detergent-active material.

3. An aqueous detergent composition according to claim 1, wherein the suspending phase (c) is a non-surfactant structuring material in the form of a polymer and/or an inorganic colloid.

4. An aqueous detergent composition according to claim 1, wherein the suspending phase (c) is a filamentary structuring material in the form of soap crystals or cellulose.

5. An aqueous detergent composition according to claim 1, also comprising a further suspended phase (d) of solid particles selected from mineral abrasive particles, builder particles, softener particles and substantially water-insoluble bleaching agent particles.

6. An aqueous detergent composition according to claim 1, comprising one or more non-alkoxylated anionic surfactants which at least predominantly form said non-network-forming phase b(i) and/or b(ii), and one or more further detergent-active materials selected from:
alkoxylated anionic surfactants;
alkoxylated nonionic surfactants;
mono-and di-alkanolamides;
amine oxides;
betaines;
sulphobetaines;
sugar ethers,
which further materials at least partly form said lamellar phase c together with said non-alkoxylated anionic surfactant.

7. An aqueous detergent composition according to claim 1, comprising at least 20% by weight of detergent-active material.

8. A method of forming a structured aqueous detergent composition according to claim 1, in which the non-network-forming phase (b) (i) and/or the non-network forming phase (b)(ii) is/are present and the lamellar phase c(i) is present, the method comprising the successive steps:
(A) preparing an aqueous solution comprising a first non-alkoxylated detergent-active component,
(B) adding electrolyte to the aqueous solution so produced in order to cause said first component to form said non-network-forming phase(s) (b)(i) and/or b(ii),
(C) forming said lamellar phase (c)(i) by at least one of the following steps:
(C1) dissolving in the solution a second detergent active component more soluble in water than said first component,
(C2) adding further electrolyte to the solution.

9. A method according to claim 8, in which said electrolyte added in step (B) has a monovalent anion while said electrolyte added in step (C2) has a polyvalent anion.

10. A method according to claim 8, wherein said electrolyte is added in less than 4% by weight and is selected from the group consisting of mono- and divalent ions.

11. A method according to claim 10, wherever said electrolyte is sodium hydroxide.

12. A structured aqueous detergent composition according to claim 1 containing detergent-active material in the form of at least one detergent-active component and at least one electrolyte and having the following phases:
(a) an isotropic aqueous solution forming a continuous phase;
(b) distributed and suspended in said solution (a) discrete units of one or more non-network forming phases, each selected from the following:
(i) solid particles containing detergent-active material,
(ii) lyotropic liquid crystals containing detergent-active material; and (iii) non-encapsulated liquid droplets containing detergent-active material; and (c) one or more suspending phases which cause the composition to be structured so as to suspend the non-network forming phase (b);

said non-network forming phase (b) having a higher concentration by weight of detergent-active material than said aqueous solution (a);

wherein, when said discrete units of non-network forming phase are defined as in (b) (i) or (b) (ii), the discrete units are formed in situ, and when said discrete units are defined as in (b) (iii), the discrete units are formed by dissolving the active materials including the detergent active materials in water and adding electrolyte with stirring to form phase (b) (iii) and (c).

13. A structured aqueous detergent composition according to claim 12, wherein discrete units (b) (i) and (b) (ii) which are formed in situ are formed before the formation of suspending phase (c).

* * * * *